US005408787A

United States Patent [19]

Barnett

[11] Patent Number: 5,408,787

[45] Date of Patent: Apr. 25, 1995

[54] MAUSOLEUM CONSTRUCTION

[76] Inventor: Jerome J. Barnett, 516 Terrace Ave., Toms River, N.J. 08753

[21] Appl. No.: 147,193

[22] Filed: Nov. 3, 1993

[51] Int. Cl.[6] ..... E04H 14/00

[52] U.S. Cl. ..... 52/134; 52/131; 52/132; 52/136; 27/6

[58] Field of Search ..... 52/134, 128, 131, 132, 52/136; 27/6, 15; 220/1.5, 4.26, 4.28, 677, 692, 693

[56] References Cited

U.S. PATENT DOCUMENTS

| | | | |
|---|---|---|---|
| Re. 33,636 | 7/1991 | Yearsley . | |
| 915,168 | 3/1909 | Fisk et al. . | |
| 975,779 | 11/1910 | Moore . | |
| 1,012,893 | 12/1911 | Moore . | |
| 1,034,455 | 8/1912 | Hunter . | |
| 1,051,386 | 1/1913 | Bricker . | |
| 1,078,929 | 11/1913 | Landis . | |
| 1,093,940 | 4/1914 | Leland et al. . | |
| 1,115,284 | 10/1914 | Collett . | |
| 1,183,323 | 5/1916 | Sievert . | |
| 1,189,203 | 6/1916 | Kern et al. . | |
| 1,406,192 | 2/1922 | Kennedy | 52/134 X |
| 1,592,991 | 7/1926 | Sanders . | |
| 1,641,123 | 8/1927 | Cullinan . | |
| 1,691,568 | 11/1928 | Gorman | 52/131 |
| 1,815,883 | 7/1931 | Davis . | |
| 2,783,523 | 3/1957 | Halley . | |
| 3,263,853 | 8/1966 | Smith | 220/4.26 X |
| 3,564,796 | 2/1971 | Smith . | |
| 3,938,287 | 2/1976 | Gauchard . | |
| 3,945,094 | 3/1976 | Dárán et al. | 52/134 X |
| 4,463,484 | 8/1984 | Valle Arizpe . | |
| 4,669,157 | 6/1987 | Schwarten | 52/134 X |
| 4,727,632 | 3/1988 | Yearsley | 52/134 X |
| 4,862,655 | 9/1989 | Le Page et al. | 52/131 X |
| 5,076,151 | 12/1991 | Carnier | 52/134 X |

*Primary Examiner*—Carl D. Friedman
*Assistant Examiner*—Christopher Todd Kent
*Attorney, Agent, or Firm*—Seidel Gonda Lavorgna & Monaco

[57] ABSTRACT

An hermetically sealed module for a mausoleum is disclosed having a bottom member of predetermined dimensions, a cover member having dimensions which are complementary with respect to the bottom member, and a door member having predetermined dimensions which are complementary with respect to both the bottom and the cover members. The top member is laid upon the bottom member so as to provide a cavity for receiving a container having a decomposable corpse therein. The door member closes off the cavity. All mating surfaces between the bottom member, cover member and door member are sealed from inside and provide for an hermetically sealed module to be installed into a mausoleum. The mausoleum is provided with drain vents and air vents. The air vents in cooperation with fan devices provide a circulating system that not only purges the vaults of the decomposition gases of the body but also creates an evaporation process which assists in the removal of any decomposition fluids within the module. In one embodiment, a framework upon which the modules rest is provided. The framework serves to reduce the cost of mausoleum and the time required for construction. The mausoleum provides favorable aspects to meet environmental considerations.

18 Claims, 5 Drawing Sheets

FIG. 6
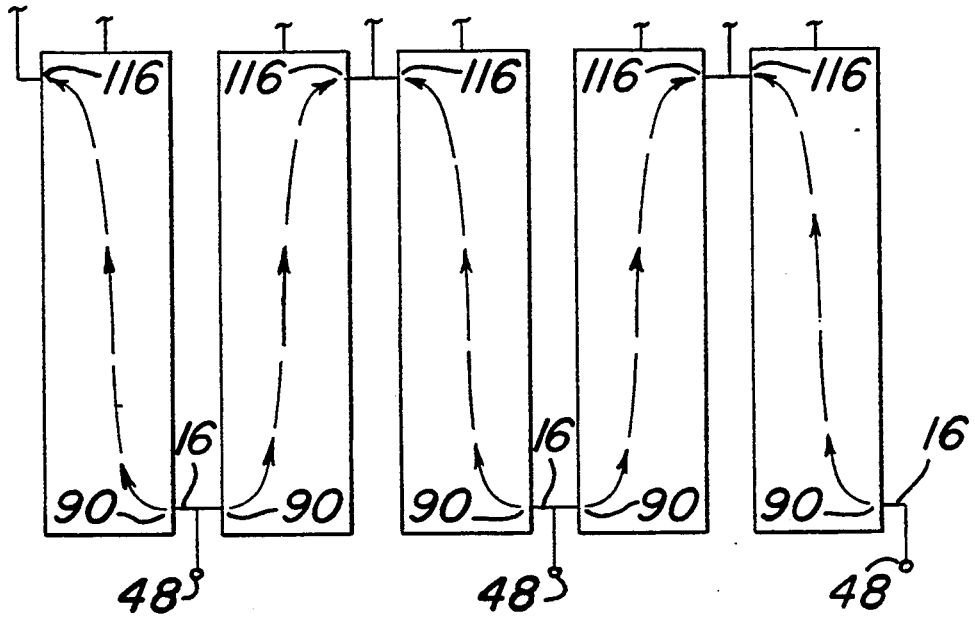
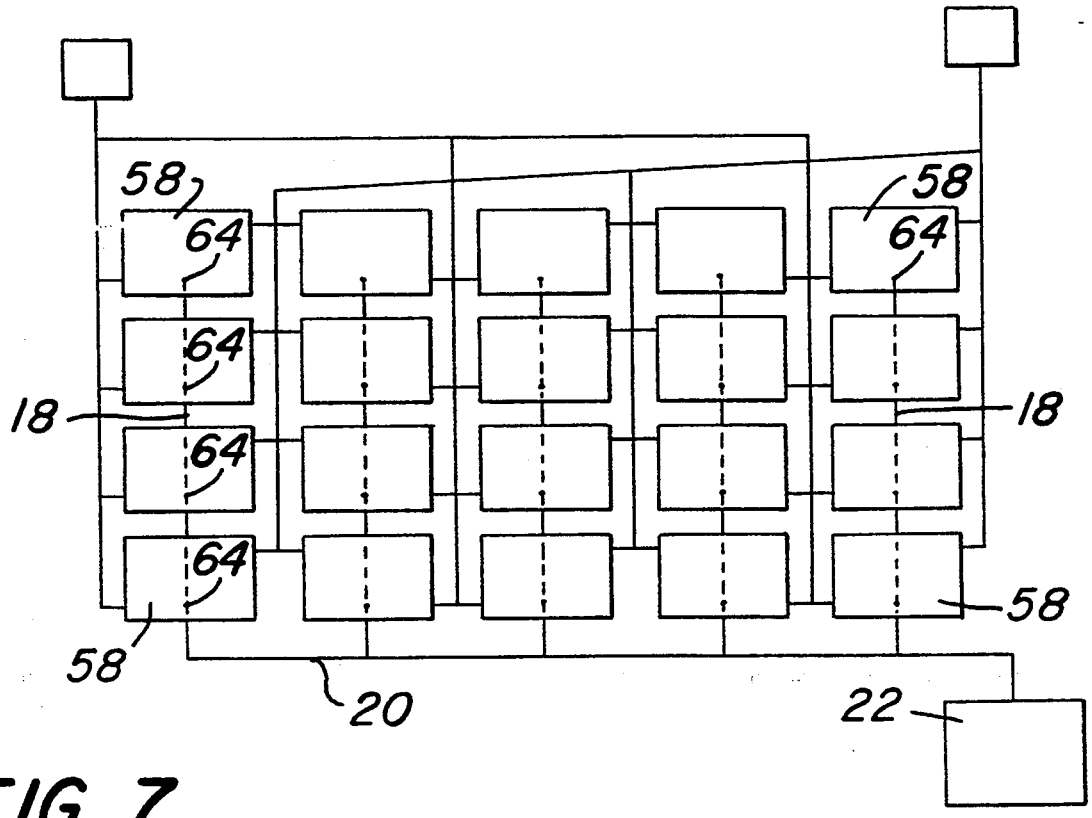
FIG. 7

MAUSOLEUM CONSTRUCTION

FIELD OF THE INVENTION

The present invention relates to mausoleums and, more particularly, to sealed modules for receiving decomposable corpses and an arrangement of drain and air vents that not only remove decomposition gases, but also create an evaporation process so as to prevent the accumulation of decomposition fluids within the module and, therefore, within the mausoleums.

BACKGROUND OF THE INVENTION

Mausoleums are usually stone buildings, either above or below the ground, that provide entombment of the dead which are first placed into coffins or caskets. As part of mausoleum structures, the coffins are typically placed into crypts or vaults. The vaults are compartments formed by the walls and floors of the mausoleum itself. The walls of the vaults have provisions to accommodate the insertion of piping or conduits which serve as air and drain vents. The cost of constructing a stone mausoleum having the integral compartments is usually high. Also, the time required for such construction is usually quite long. It is desired that means be provided to reduce the cost and time required for such mausoleum construction, while at the same time providing for the proper entombment of the dead.

After a corpse is placed in the vault of the mausoleum, the body begins a decomposition process giving off liquid and gases. The mausoleums are commonly provided with air vents to remove decomposition gases from the vault and drain vents to remove decomposition fluids and to direct them into the earth.

In recent times it has become readily apparent that the environmental impact of mausoleums related to the removal of the decomposition gases and fluids must be taken into account. In particular, it is important that the odors created by the decomposition liquid and gases be controlled and also reduced as much as possible before their release into the atmosphere or into the surface of the earth.

SUMMARY OF THE INVENTION

The present invention is directed to a mausoleum having separate and hermetically sealed modules serving as vaults that receive decomposable corpses and which are arranged with air and drain ducts that remove the decomposition gases and fluids from the module in an effective manner. Further, the present invention is directed to means for reducing the cost and time normally required for the construction of a mausoleum.

The hermetically sealed module comprises a bottom member, a cover member, and a door member. The bottom member has predetermined dimensions and three upwardly extending vertical walls each having edges projecting outward and running the full length of the top of each of the walls. Each wall has at least one crease running between diagonally opposite corners. Two of the three walls form opposite side walls and the third wall forms a rear wall. The three walls of the bottom member are brought together by a floor. The cover member has dimensions which are complementary with respect to the bottom member. The cover member has three downwardly extending vertical walls each having edges projecting outwardly and preferably running the full length of each wall. The three walls are brought together by a top. Two of the three walls form opposite side walls and the third wall forms a rear wall having a passageway therein. Each of the side walls has at least one crease running between diagonally opposite corners. The edges of the cover member are arranged to rest on and to be sealed to the edges of the bottom member. When the cover member rests on the bottom member, a cavity is provided for receiving the container having the decomposable corpse therein. The door member has predetermined dimensions which are complementary with respect to the bottom and cover members. The door member is arranged to close off the cavity and to be sealed to both the bottom and cover members.

In one embodiment of the present invention, the modules are placed onto vertically separated floors which divide the mausoleum into tiers. The floors have openings therein at predetermined locations. The mausoleum includes a conduit running through the openings in the floor. The conduit has one section connected to a fluid disposal and to two sections which provide two separate paths for gas disposal. The first path is connected to means for drawing air into the mausoleum and the second path being connected to means for drawing air out of the mausoleum. The hermetically sealed modules are interconnected to the conduit means so that decomposition fluids are drained into the fluid disposal means. The passage of air that enters the module, and then exits the module, creates an evaporation effect which not only removes decomposition gases from the module, but also assists in the removal of the decomposition fluids.

In another embodiment of the present invention, the mausoleum comprises a framework having racks for dividing the mausoleum into tiers and for accepting and supporting the hermetically sealed modules. This embodiment is particularly suited for reducing the cost and time normally required for the construction of the mausoleum.

Other objects, advantages and novel features of the present invention will become apparent in the following detailed description of the invention when considered in conjunction with the accompanying drawings.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 6 is a top view showing a single row of vault modules.

FIG. 7 is a front view showing a plurality of tiers and columns of vault modules.

DETAILED DESCRIPTION OF THE INVENTION

Figure 1:
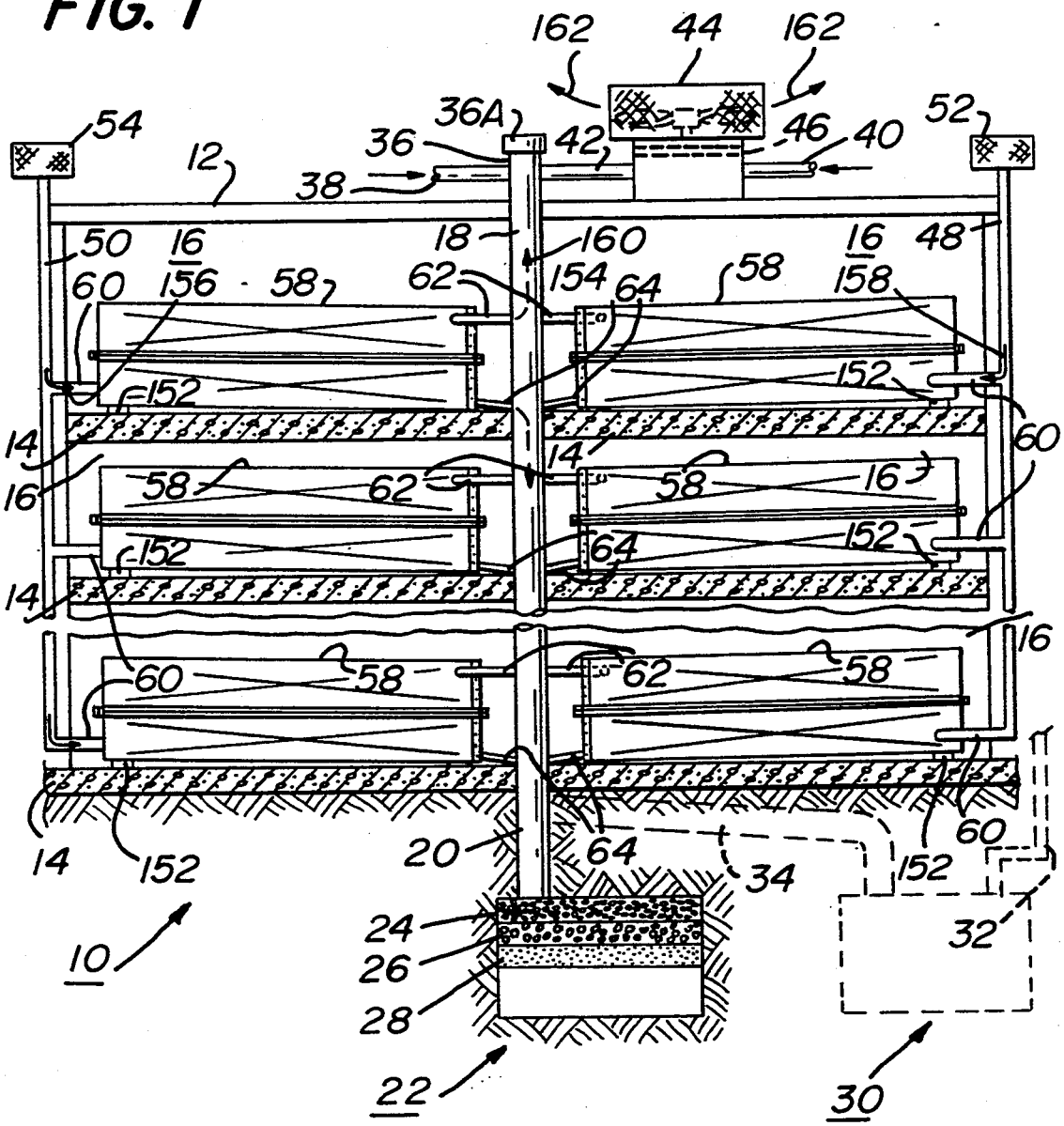
FIG. 1 is a functional illustration of a portion of the mausoleum according to one embodiment of the present invention.

In the Figures, where like numerals illustrate like elements, there is shown in FIG. 1 a functional illustration of a mausoleum 10 as contemplated by the present invention. The mausoleum 10 includes a top or roof section 12. FIG. 1 only illustrates a portion of the mausoleum 10, but shows the elements which are considered important to overall mausoleum construction. The mausoleum 10 includes a top or roof section 12 and has floors 14 which separate the mausoleum into tiers 16. The mausoleum further comprises conduit means 18 that run through openings in the floors 14. The conduits preferably comprise polyvinyl chloride (PVC) piping having an inner diameter in the range from about 1.25 inches to about 1.50 inches. The conduit 18 has a lower section 20 connected to fluid disposal means 22.

The fluid disposal means 22 preferably has a filter positioned at its input stage comprising a first layer 24, a second layer 26, and a third layer 28 of filtering material respectively comprising stone, charcoal and sand. In an alternate embodiment, the fluid disposal means comprises a containment tank 30 formed of fiberglass and having vent means 32 for connecting to a vacuum system (not shown) for draining fluid out of the containment tank 30. The containment tank 30 is connected to the lower section 20 preferably by a PVC pipe 34 shown in phantom.

The conduit means 18 further comprises a T-section 36 having access means comprising a removable cover 36A, both of which are preferably located above the roof 12. The conduit means still further comprises sections 38 and 40 interconnected to other portions (not shown) of the mausoleum 10. The section 38 is interconnected to a further section 42 of the conduit means which, in turn, is connected to means 44 that has section 40 also connected thereto. Sections 38, 40 and 42 all comprise a first path that is connected to means 44 for drawing air out of the mausoleum. The means 44 may comprise an electric fan that cooperates with a filter 46 (shown in phantom), preferably of the charcoal type, to cleanse the air of the mausoleum before it is dispersed into the atmosphere.

The conduit means 18 still further comprises a second path having one or more branches, such as pipes 48 and 50 preferably formed of PVC piping, that are respectively interconnected to fans 52 and 54 mounted on the roof 12 of mausoleum 10. The branches 48 and 50 run vertically along the outside of each of the tiers 16. Each of the branches 48 and 50 is interconnected to about twelve (12) modules 58 which serve as crypts or vaults of the mausoleum 10. The modules 58 are shown in FIG. 1 as resting on the floors 14. The fans 52 and 54 for branches 48 and 50 both serve as means for drawing air into the mausoleum, in particular, into the modules 58.

The modules 58 are interconnected to the paths 48 and 50 by tubular means 60 preferably formed of PVC piping. The modules 58 are also connected to the conduit means 18 by way of tubular means 62 and 64, also preferably formed of PVC piping. The modules 58 are hermetically sealed, and may be further described with reference to FIG. 2.

Figure 2:
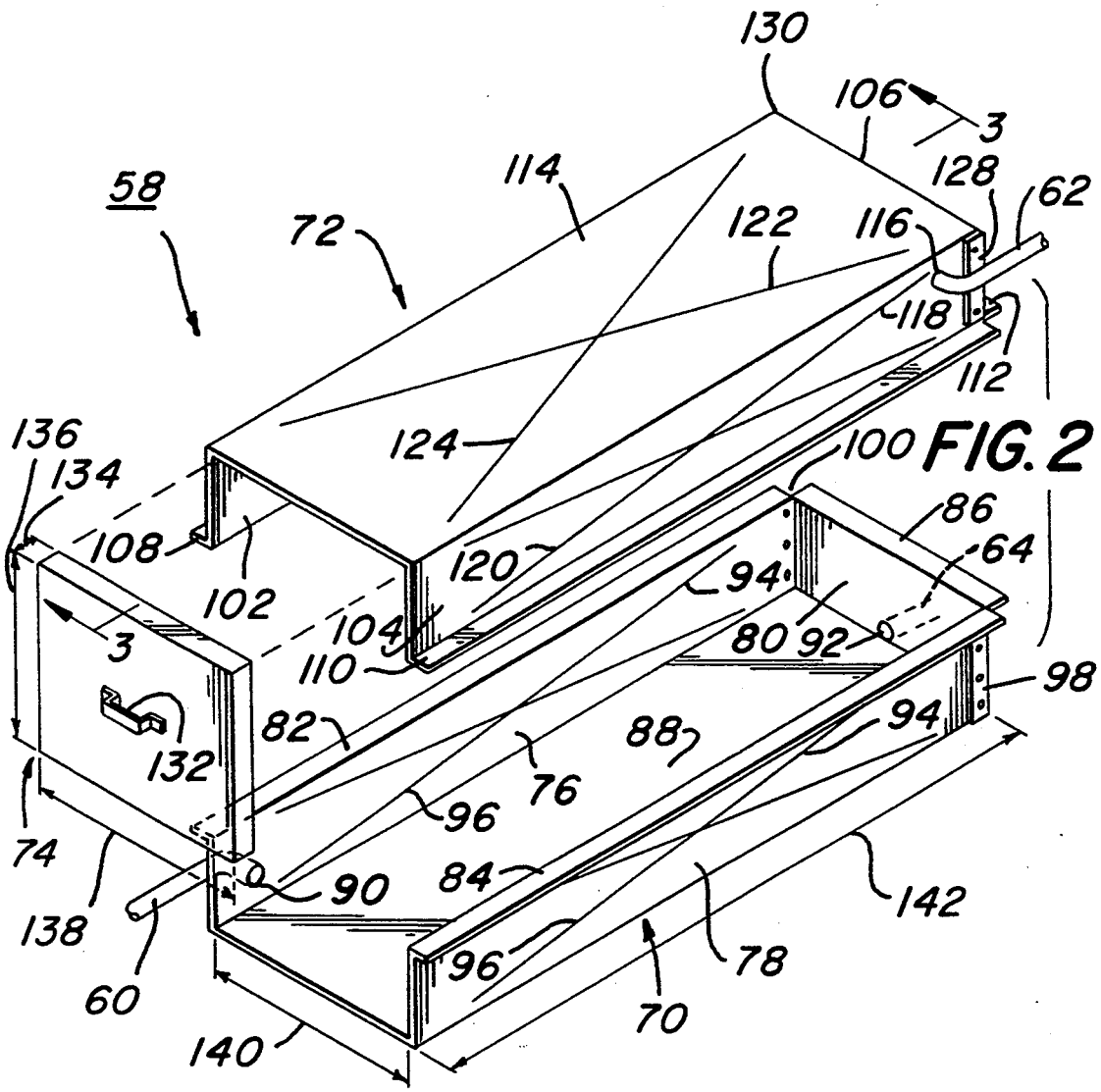
FIG. 2 is an exploded isometric view of a sealed module of the present invention.

FIG. 2 is an exploded isometric view illustrating a hermetically sealed module 58 comprising a bottom member 70, a cover member 72, and a door member 74. The bottom member 70 has predetermined dimensions and three upwardly extending vertical walls 76, 78 and 80, each respectively having outwardly projecting edges 82, 84 and 86 that run the full length of the top portion of each wall 76, 78 and 80. Two of the walls 76 and 78 comprise opposite sides and the third wall 80 comprises a rear wall for the module 58. The three walls 76, 78 and 80 are brought together in a blended manner by a floor portion 88. One of the side walls, such as wall 76, has a passageway 90 which is located near the corner of wall 76 which is farthest away from the rear wall 80. The rear wall 80 has a passageway 92 near its lowermost portion. Each of the side walls has at least one (but preferably two) crease 94 (and 96) running from and between regions of diagonally opposite corners of the respective wall. The creases 94 and 96 are outwardly extending protrusions that may be placed or imprinted into the surfaces of the side walls 76 and 78. The creases 94 and 96 serve as strengthening means making the bottom member 70 difficult to bend especially in its vertical direction. The bottom member 70 further comprises brackets 98 and 100 located at the corners at which the side walls 76 and 78 are joined to rear wall 80. Brackets 98, 100 provide structural support for bottom member 70 in its vertical direction.

The passageway 90 of bottom member 70 serves as an air vent and is shown as having connected thereto a tubular means 60. Passageway 92 in bottom member 70 serves as a drain vent and is shown as having connected thereto a downward, sloping tubular means 64.

The cover member 72 has dimensions which are complementary with respect to the bottom member, and has three downwardly extending vertical walls 102, 104 and 106 (not completely shown) having edges 108, 110 and 112, respectively, projecting outward and running the full length of the bottom portion of each. The three walls 102, 104 and 106 are brought together, in a blended manner, by a top member 114. Two of the walls 102 and 104 comprise opposite side walls and the third wall 106 comprises a rear wall. A passageway 116 is located in one or the other of the side walls 102, 104 (wall 104 in FIG. 2) and preferably positioned according to where in the arrangement of modules the individual module 58 will be placed (see description of FIG. 6). The passageway 116 is located substantially at the top of side wall 104 and in close proximity to rear wall 106. The passageway 116 serves as an air vent and has tubular means 62 connected thereto. Each side wall 102 and 104 has at least one, (but preferably two) crease 118 (and 120) running from and between regions of diagonally opposite corners of the respective wall. Similarly, the top portion 114 has at least one (but preferably two) crease 122 (and 124) running from and between regions of oppositely diagonal corners. The creases 118, 120, 122 and 124 are formed and operate in a same manner as that described for creases 94 and 96 so as to provide strengthening means for the cover member 72. Similarly, the cover member 72 has braces 128 and 130 (not shown), located at the corners at which the side walls 102 and 104 are joined to rear wall 106, and which operate to vertically strengthen cover member 72 in a similar manner as described for braces 98 and 100 of the bottom member 70.

The door member 74 preferably comprises a handle 132 and has predetermined dimensions which are complementary with respect to both the bottom 70 and cover 72 members. The door 74 has predetermined dimensions 134, 136 and 138. The bottom member 70 and cover 72 both also have predetermined dimensions 140 and 142 (all shown in FIG. 2). The module 58 itself has a dimension 144 shown in FIG. 3. All of such dimensions are given in Table 1 along with their typical values.

TABLE 1

| Dimension | Typical Value |
|---|---|
| 134 | 1 inch |
| 136 | 26 inebes |
| 138 | in the range from about 32 inches to about 34 inches |
| 140 | in the range from about 32 inches to 34 inches |
| 142 | in the range from about 8 feet (single vault) to about 16 feet (double vault) |

The bottom member 70 and the cover member 72 preferably comprise galvanized steel metal of about 18 to 20 gauge and have creases 94, 96, 118, 120, 122 and 124 imprinted in the sheet metal. The door member 74 also preferably comprises galvanized steel. Further, the material used for all members 70, 72 and 74 is preferably impervious to the decomposition fluids and gases of the body.

The modules 58 formed by members 70, 72 and 74, in their practical application, receive a container, such as a coffin (not shown for the sake of clarity), having a decomposable corpse therein. The coffin is placed and rested onto the floor 88 of the module 58. As to be described hereinafter, propping members are placed between the coffin and the floor so as to elevate and tilt the coffin with respect to the bottom member 70, in particular, the drain vent 90. After the coffin is placed on the floor 88, cover member 72 is then placed onto the bottom member 70 so that the complementary outwardly projected edges of both members 72 and 70 are in substantial alignment. The hollow formed between the bottom member 70 and the cover member 72 serves as a cavity for housing the coffin. The door member 74 is then mated to both members 70 and 72 so as to close off the formed cavity.

All mating portions of the bottom member, cover member and door member are sealed on the inside so as to provide an hermetically sealed module 58 upon placement into its respective tier 16 of the mausoleum 10 (FIG. 1). The sealing of the module 58 by preferably using a flexible and resilient elastomer silicon may be further understood with reference to FIG. 3.

Figure 3:
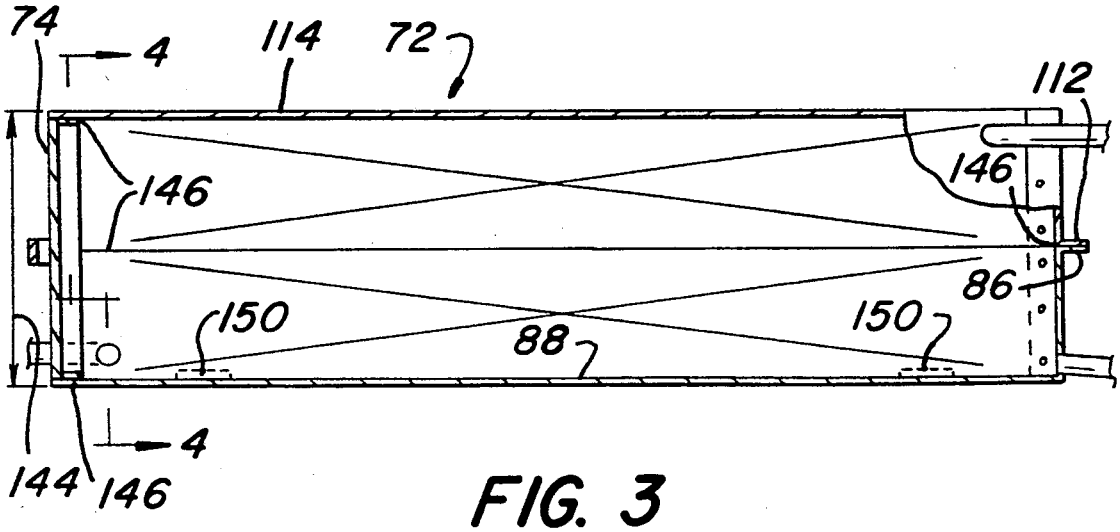
FIG. 3 is a sectional view taken along line 3—3 of the sealed module of FIG. 2.

FIG. 3 shows a continuous sealant 146, indicated by a dark line, evenly spread across and mating the surfaces of the bottom member 70, cover member 72, and door member 74. More particularly, FIG. 3 illustrates the sealant 146 mating the top and bottom portions of the door 74 to top member 114 and floor member 88 respectively. Further, FIG. 3 shows the projecting edges 86 and 112 as being mated with sealant 146. FIG. 3 also illustrates the sealant 146 mating the door 74 to the top portion 114 of the cover 72. The sealing of the module 58 may be further described with reference to FIG. 4 which is a view taken along line 4—4 of FIG. 3.

Figure 4:
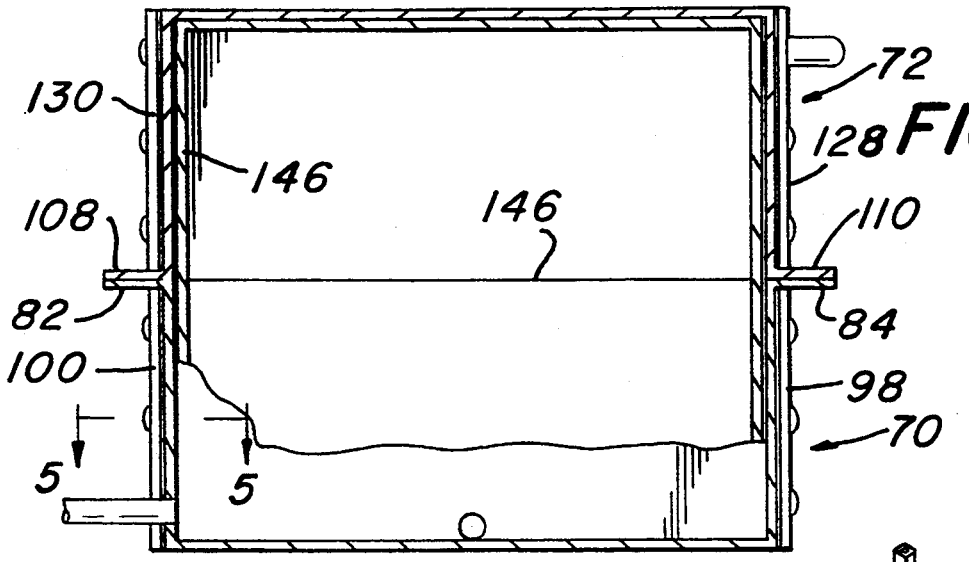
FIG. 4 is a sectional view taken along line 4—4 of the sealed module of FIG. 3.

FIG. 4 illustrates the placement of further sealant 146 cooperating to provide for an hermetically sealed module 58. The sealant 146 mates the outwardly extending edge 82 to edge 108, and edge 84 to edge 110. FIG. 4 further illustrates the sealing of bracing members 98, 100, 128 and 130 which may be further understood with reference to FIG. 5 which is a view taken along line 5—5 of FIG. 4.

Figure 5:
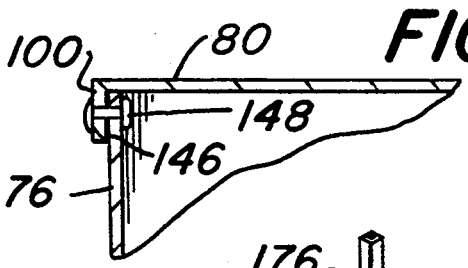
FIG. 5 is a partial sectional view taken along line 5—5 of the sealed module of FIG. 4.

FIG. 5 illustrates the bracing member 100 (which in reality is an extension portion 100 of rear wall 80) that overlaps the side wall 76. The overlapping portions 100 and 76 are merged together by means of the sealant 146 and are firmly affixed to each other, preferably, by rivet means 148. Referring back to FIG. 4, brackets 98, 128 and 130 are arranged and sealed in a manner similar to that of bracing member 100.

It should now be appreciated that the practice of the present invention provides a module 58 for receiving a container having a decomposable corpse therein, and which module provides a water and air tight seal created by a sealant, preferably of a silicon type, placed onto the inside surfaces of module 58 and which sealant causes all members of the module to be sealed to each other.

The module 58 preferably further comprises propping members 150, shown in FIG. 3 in phantom, which allow the container, having the corpse therein and placed on these blocking members 150, to be raised above the floor 88, thereby allowing for the circulation of air between the container and the floor 88. The circulation of air may be further described with reference to FIG. 1.

As seen in FIG. 1, the module 58 is preferably placed onto additional propping members 152 which elevate and tilt the vault 58 so that the decomposition fluids of its confined corpse may be more readily directed to the drain vents 64, thereby allowing such fluids to more easily flow, as shown by arrow 154, into conduit means 18 and down into the fluid disposal means 22.

The body decomposition fluids are also removed from the modules 58 by means of an evaporation process established by the previously mentioned two conduit branches 48 and 50 respectively connected to fan means 52 and 54. This evaporation process reduces the accumulation of the decomposition fluids within the modules 58 which would otherwise contribute to unpleasant odors emanating from the mausoleum which are offensive to the environment.

In operation, the fans 52 and 54 cause air, shown by arrows 156 and 158, to be forced into their respective modules 58. The incoming air currents 156 and 158 flow under the container that is within the module 58, across the floor 88 of the module 58, and thereafter up to and out of the tubular means 62. The air that exits tubular means 62, shown by arrow 160 in the upper portion of conduit means 18, is drawn upward by fan 44, passes through the charcoal filter 46, and is then dispersed as filtered-cleansed air, arrows 162.

FIGS. 6 and 7 illustrate the organization of the tubular means and conduits which interconnect the modules permitting evacuation of gases and fluids within a mausoleum constructed according to the present invention. FIG. 6, a top view of a tier of modules 58, shows that the air inflow passageways 90 near the front of the individual modules 58 are arranged to permit one air inflow branch 48 to supply forced-air through tubular means 16 into two adjacent modules 58. A similar arrangement is employed for the outflow passageways 116 at the rear of the modules 58. The air exits the modules 58 through tubular means 62, which connect in pairs to exhaust conduit means 42. This arrangement reduces construction costs by saving the PVC material that would be necessary to provide separate air branches to each column of modules 58.

FIG. 7, a front view of an array of modules 58, shows the interconnection of the fluid drain tubular means 64 to the common fluid conduit means 18 at the rear of the modules 58. The common fluid conduit means 18 is arranged vertically down the rear of each column of modules 58. Each respective vertical conduit means 18 is connected to the horizontal lower section 20 which leads to the fluid disposal means 22 of one embodiment of the invention or the containment tank 30 of an alternative embodiment (shown in phantom in FIG. 1).

Referring again to FIG, 1, the circulatory system shown by arrows 156, 158, 160 and 162 creates an evaporation process, which not only purges the modules 58 of the decomposition gases, but also assists in removing any decomposition fluids that may be within the module 58. It is intended that no substantial amount of fluids accumulate within the modules themselves. Such a system more effectively rids the mausoleum 10 of its unpleasant odors, thereby making the mausoleum more responsive to environmental considerations.

Figure 8:
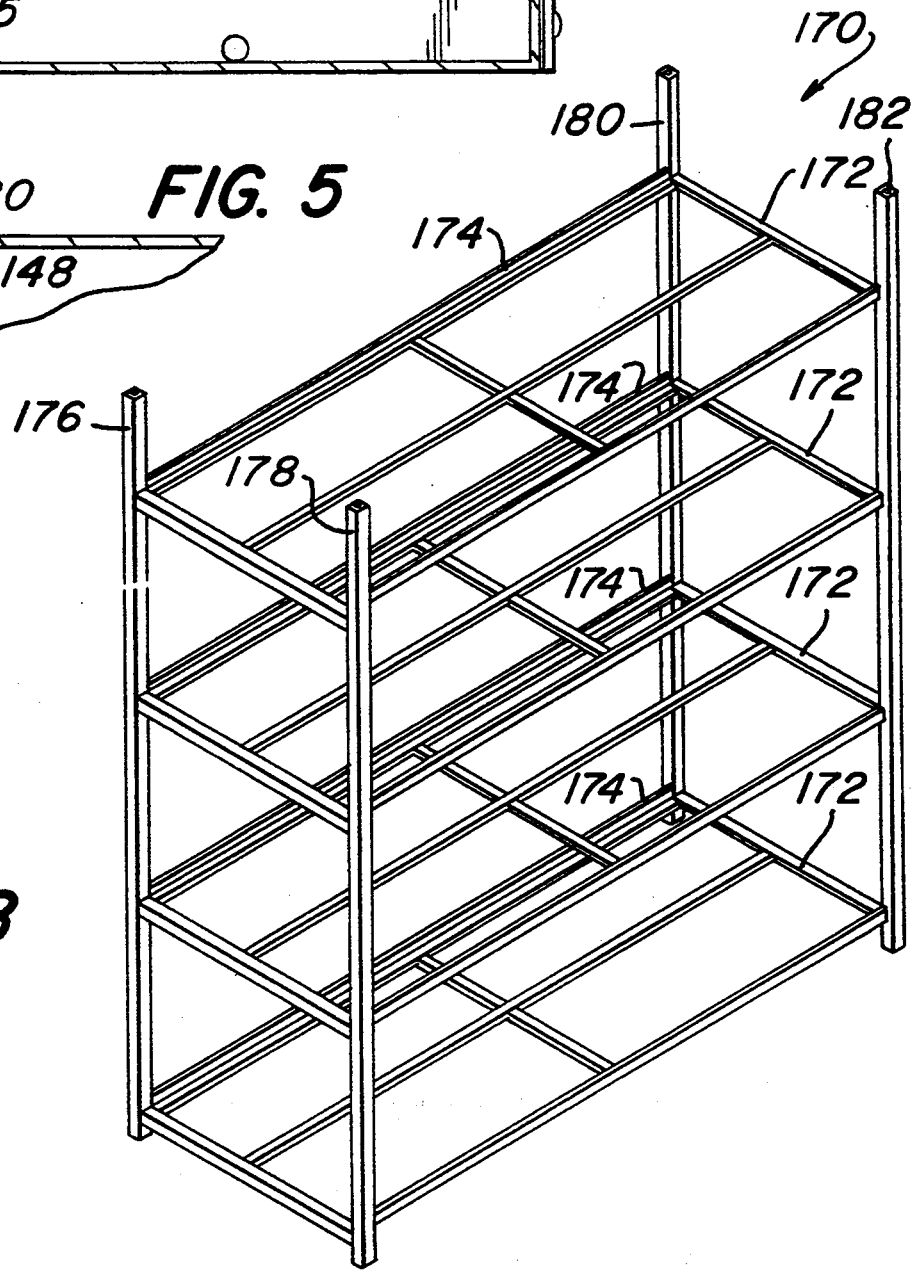
FIG. 8 illustrates a framework which facilitates and reduces the cost of construction of the mausoleum of the present invention.

The present invention further comprises a framework 170, shown in FIG. 8, that advantageously reduces the cost of the construction of the mausoleum, as well as reduces the necessary time for such a construction. The framework 170 has a plurality of racks 172 each of which preferably comprises one side that has a ledge 174 of about one (1) inch and upon which modules 58 rest. The ledge 174 may be used to preferentially direct the decomposition fluid to the drain vent 64. This ledge 174 may also be incorporated into the floors 14 of FIG. 1, so as to replace the propping member 152 while at the same time accomplishing the desired preferential draining of the decomposition fluids. The framework 170 of FIG. 8 further comprises four upright members 176, 178, 180 and 182 that are firmly connected to the four corners of each of the racks 172 by appropriate means, such as welding. Each of the upright members 176, 178, 180 and 182 preferably further comprise means 184 that frictionally engages the floor of the mausoleum upon which these members rest. The arrangement of the framework 170 in a mausoleum may be further understood with reference to a second embodiment 200 of the present invention shown in FIG. 9.

Figure 9:
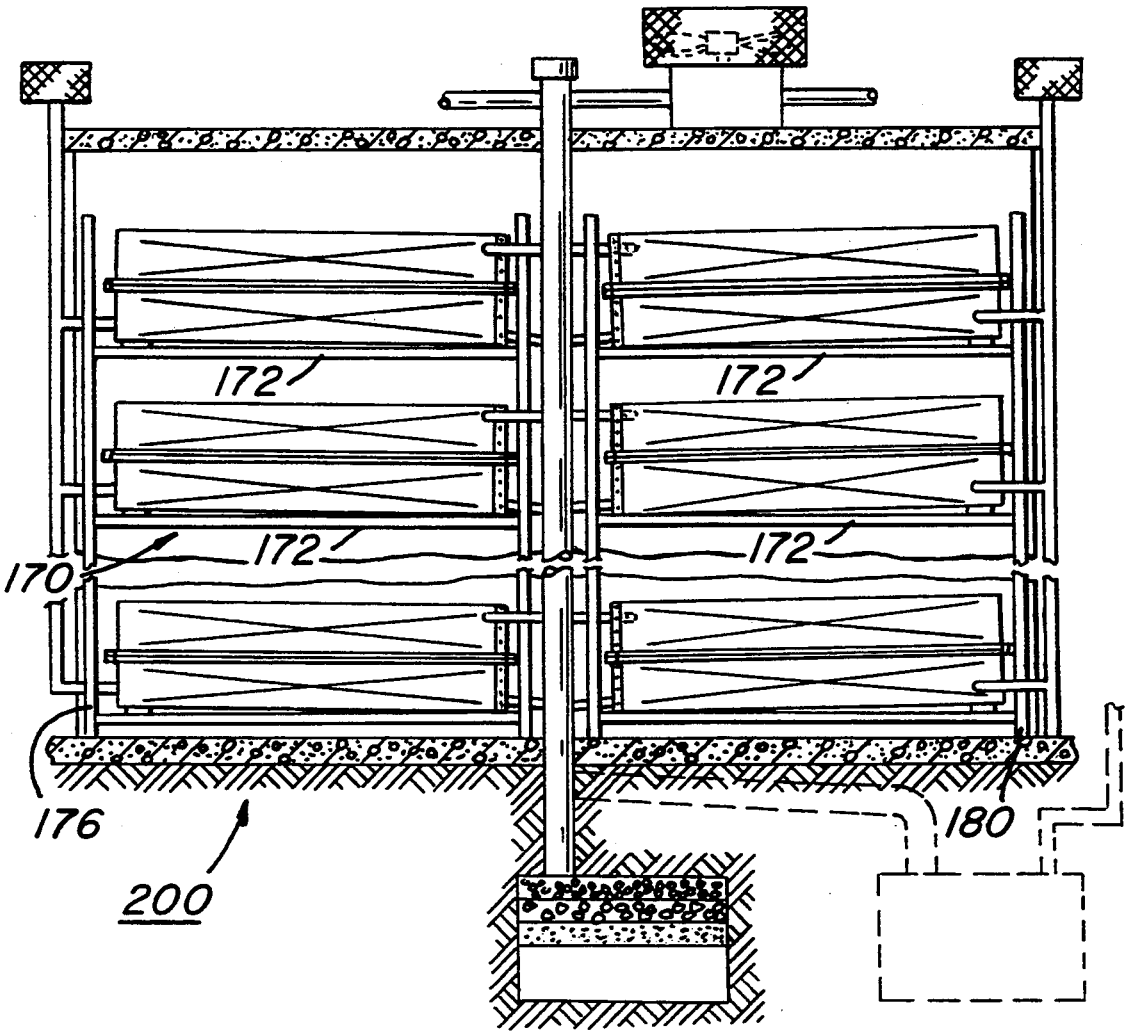
FIG. 9 is a functional illustration of a portion of a mausoleum that incorporates the framework of FIG. 8 which divides the mausoleum into tiers and which supports the sealed modules of the present invention.

The arrangement of FIG. 9 is quite similar to that of FIG. 1, with the exception that the framework 170 of FIG. 8 replaces the granite floors 14 of FIG. 1. Further, the upright members, such as 176 and 180, rest upon the bottom floor 14 of the mausoleum 200. Moreover, the modules 58 rest on the racks 172, thereby eliminating the floors 14 of FIG. 1 that divide the mausoleum 10 into tiers. Other than these differences, the arrangement of FIG. 9 operates in a similar manner as that described for FIG. 1. However, for example, the arrangement of FIG. 9, due to the elimination of the separating floors 14, provides for a construction of a mausoleum that is not only reduced in cost, but is also reduced in the time required for construction.

The present invention may be embodied in other specific forms without departing from the spirit or essential attributes thereof and, accordingly, reference should be made to the appended claims, rather than to the foregoing specification, as indicating the scope of the invention.

What I claim is:

1. An hermetically sealed module for a mausoleum, said module adapted for receiving a container having a decomposable corpse therein, said module comprising:

(a) a bottom member having predetermined dimensions and three upwardly extending vertical walls each having edges projecting outward and running the full length of the top portion of each of said three walls, said three walls being brought together by a floor member, two of said three walls comprising opposite side walls and the third of said three walls comprising a rear wall having a passageway near its lowermost portion, each of said side walls having at least one crease running between diagonally opposite corners, one of said side walls having a passageway located near a corner which is furthest away from said rear wall;

(b) a cover member having dimensions which are complementary with respect to said bottom member, said cover member having three downwardly extending vertical walls each having edges projecting outward and running the complete length of the bottom portion of each of said three walls, said three walls being brought together by a top member, two of said walls comprising opposite side walls and the third of said three walls comprising a rear wall having a passageway, each of said side walls and said top member having at least one crease running between diagonally opposite corners, said edges of said cover member being arranged to rest on and to be sealed to said outwardly projecting edges of said bottom member, said cover member resting on said bottom member providing a cavity for receiving said container having said corpse therein; and (c) a door member having predetermined dimensions which are complementary with respect to both of said bottom and cover members, said door member closing off said cavity and being sealed to both said bottom and cover members.

2. An hermetically sealed module for a mausoleum according to claim 1, wherein said door member has a handle affixed thereto.

3. An hermetically sealed module for a mausoleum according to claim 1, wherein each of said bottom and cover members further comprises means for bracing each of said respective side walls to each of said respective rear walls.

4. An hermetically sealed module for a mausoleum according to claim 1, wherein each of said side walls of both of said bottom and cover members have two creases each running from and between diagonally opposite corners and which creases intersect each other at about the central region of the respective side walls.

5. A mausoleum comprising a roof and vertically separated floors dividing said mausoleum into tiers, said floors having openings at predetermined locations, said mausoleum further comprising:

(a) conduit means running through said openings of said floors and having a section connected to fluid disposal means and two sections provide two separate paths with the first path being connected to means for drawing air out of the mausoleum and the second path being connected to means for drawing air into said mausoleum; and (b) a plurality of hermetically sealed modules resting on said floors and adopted for housing a container having a corpse therein, each of said modules comprising a floor portion, and a dimensionally complimentary cover portion each comprising a planar portion and three projecting walls having outwardly projecting edges; said floor portion and said cover portion assembled forming two opposite side wall portions and a rear portion and a door member having predetermined dimensions which are complementary with respect to both of said floor and said cover portions, said door member closing off said cavity and being sealed to both said floor and said cover portions, said two opposite side wall portions and said cover planer portion having creases into their surfaces to resist bending thereof, one of said side walls having an air vent, said rear portion having a drain vent at its lowermost portion and an air vent, said drain vent having tubular means for connecting to said lower section of said conduit means connected to said fluid disposal means, said air vent of said rear portion and said air vent of said side portion having tubular means for respectively coupling to said first and second paths of said conduit means;

whereby the passage of air which enters said module and then exits said module creates an evaporation effect which not only removes decomposition gases from the module, but also assists in the removal of the decomposition fluids from the module.

6. A mausoleum according to claim 5, further comprising members placed on said floor of said module so as to elevate and tilt said container relative to said drain vent of said module so that any fluid draining from said container preferentially runs toward said drain vent.

7. A mausoleum according to claim 5, wherein said sealed module is comprised of a material which is impervious to the decomposition fluids and gases of the body.

8. A mausoleum according to claim 5, wherein said means for drawing air out of said mausoleum comprises a charcoal filter for cleansing the air before being discharged into the atmosphere.

9. A mausoleum according to claim 5, wherein said conduit means comprises a polyvinyl chloride (PVC) pipe.

10. A mausoleum according to claim 9, wherein said PVC pipe has an inner diameter in the range from about 1.25 inches to about 1.50 inches.

11. A mausoleum according to claim 5, wherein said fluid disposal means has a filter in its input stage comprising a first, a second and a third layer of filtering material respectively comprising stone, charcoal and sand.

12. A mausoleum according to claim 5, wherein said fluid disposal means comprises a containment tank formed of fiberglass and having a vent means for connecting to a vacuum system for draining fluid out of said containment tank.

13. A mausoleum according to claim 5, wherein each of said floors dividing said mausoleum into tiers further comprises a ledge having a height of about one (1) inch upon which one side wall of said module as well as said front portion of said module both rest, said rear portion of said module and said one inch wall being spaced apart from each other by separation means.

14. A mausoleum comprising at least one framework having racks dividing said mausoleum into tiers, said mausoleum further comprising:

(a) conduit means positioned near said racks and having upper and lower sections, said lower section being connected to fluid disposal means and said upper section having two paths with the first path being connected to means for drawing air into the mausoleum and the second path being connected to means for drawing air out of said mausoleum; and (b) a plurality of hermetically sealed modules resting on said racks and adapted for housing a container having a decomposable corpse therein, each of said modules comprising a floor portion and a dimensionally complementary cover portion each comprising a planar portion and three projecting walls having outwardly projecting edges; said floor portion and said cover portion assembled forming two opposite side wall portions and a rear portion, and a door member having predetermined dimensions which are complementary with respect to both of said floor and said cover portions, said door member closing off said cavity and being sealed to both said floor and said cover portions, said two opposite side wall portions and said cover planar portion having raised regions placed into their surfaces to resist bending thereof, one of said side walls having an air vent, said rear portion having a drain vent at its lowermost portion and an air vent, said drain vent having tubular means for connecting to said lower section of said conduit means, said air vent of said rear portion and said air vent of said side portion having tubular means for respectively coupling to said first and second paths of said conduit means;

whereby the passage of air which enters said module from said rear portion and then exits said module from said side portion creates an evaporation effect which removes decomposition fluids and gases within said sealed module.

15. A mausoleum according to claim 14, further comprising members placed on said rack of said framework so as to elevate and tilt said container relative to said drain vent of said module so that any fluid draining from said container preferentially runs toward said drain vent.

16. A mausoleum according to claim 14, wherein each of said racks has four corners and said framework comprises four upright members respectively and firmly connected to the four corners of each of said racks, each of said upright members having one of its ends resting on said floor of said mausoleum and having means for frictionally engaging said floor.

17. A mausoleum according to claim 14, wherein said upright members and said racks comprise steel material.

18. A mausoleum according to claim 14, wherein said racks are separated from each other in the vertical dimension of said mausoleum by at least twenty-six (26) inches, and each of said racks has a width, in the transverse dimension of said mausoleum, of at least thirty-four (34) inches, and a length in the horizontal dimension of said mausoleum from about eight (8) feet to about sixteen (16) feet.

* * * * *